US009366481B2

(12) United States Patent
Dietz et al.

(10) Patent No.: US 9,366,481 B2
(45) Date of Patent: Jun. 14, 2016

(54) HEAT EXCHANGER

(75) Inventors: Rainer Dietz, Gruenwald (DE); Herbert Aigner, Engelsberg (DE); Rudolf Wanke, Ottenhofen (DE); Florian Winnen, Miesbach (DE)

(73) Assignee: LINDE AG, Munich (DE)

( * ) Notice: Subject to any disclaimer, the term of this patent is extended or adjusted under 35 U.S.C. 154(b) by 571 days.

(21) Appl. No.: 12/896,053

(22) Filed: Oct. 1, 2010

(65) Prior Publication Data

US 2011/0114302 A1 May 19, 2011

(30) Foreign Application Priority Data

Oct. 2, 2009 (DE) ..... 10 2009 048 103

(51) Int. Cl.
*F28D 9/00* (2006.01)
*F28F 21/08* (2006.01)

(52) U.S. Cl.
CPC ..... *F28D 9/0062* (2013.01); *F28F 21/083* (2013.01); *F28F 21/089* (2013.01); *F28F 2275/04* (2013.01); *F28F 2275/06* (2013.01); *Y10T 29/49393* (2015.01)

(58) Field of Classification Search
CPC ..... B21D 53/02; B21D 53/04; B21D 53/06; B21D 53/08; B21D 53/085; F28D 9/0062; F28D 9/0068; F28D 9/0006; F28F 2275/06; F28F 2275/04; F28F 3/005; F28F 3/08; F28F 3/086; Y10T 29/4935; Y10T 29/49373; Y10T 29/49375; Y10T 29/49389; Y10T 29/49387
USPC ..... 29/890.03, 890.039, 890.041
See application file for complete search history.

(56) References Cited

U.S. PATENT DOCUMENTS 3,359,616 A * 12/1967 Butt ..... 29/890.039
4,134,195 A * 1/1979 Jacobsen et al. ..... 29/890.038
5,644,842 A * 7/1997 Coleman ..... B21D 53/085 29/890.044

(Continued)

FOREIGN PATENT DOCUMENTS

EP 1154218 A1 11/2001
JP 0665775 U 9/1994
JP 2007077839 A 3/2007

OTHER PUBLICATIONS

ALPEMA brochure, "The Standards of the Brazed Aluminium Plate-Fin Heat Exchanger Manufacturers' Association", Second Edition 2000, (12 pages).
English language translation for JP-2007077839; published Mar. 29, 2007.
English language Abstract for EP 1154218; published Nov. 14, 2001.

(Continued)

*Primary Examiner* — Christopher Besler
(74) *Attorney, Agent, or Firm* — Millen, White, Zelano & Branigan, P.C.

(57) ABSTRACT

The invention describes a method for producing a plate heat exchanger 1. Wavy profiled sheets 9 and separating sheets 10, together with sidebars 11, are stacked one above the other, provided with solder and soldered together in such a way that a block 2 is obtained. The block is closed off outwardly by means of the cover sheets 12. The contours of the intermediate pieces 3 are milled out at the respective positions 4 on the block 2 thus obtained. In a refinement of the invention, frames are used as intermediate pieces 3. The frames 3 are positioned in the milled-out portions at the positions 4, provided with solder and tacked on by means of spot welding. Subsequently, in a second step, the frames 3 are soldered onto the heat exchanger block 2. The headers 5*a* and 5*b* are in each case welded onto the frames 3.

22 Claims, 2 Drawing Sheets

(56) References Cited

U.S. PATENT DOCUMENTS

Figure 1:
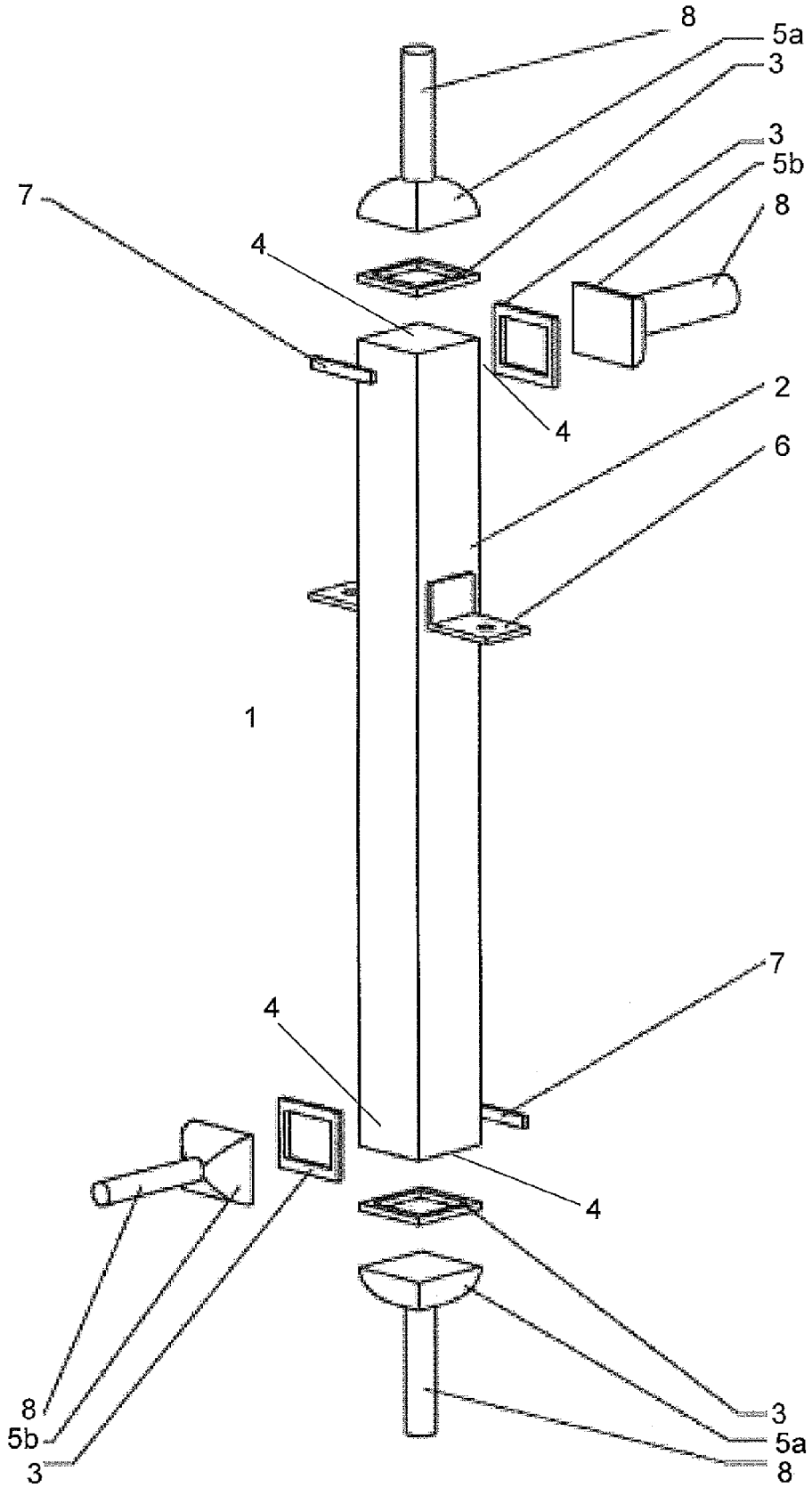

| | | | | |
|---|---|---|---|---|
| 2004/0074724 | A1* | 4/2004 | Bruck et al. | 188/378 |
| 2006/0048931 | A1* | 3/2006 | Dierbeck | 165/181 |
| 2006/0196052 | A1* | 9/2006 | Lesage | 29/890.043 |
| 2009/0094110 | A1 | 4/2009 | Hoque | |
| 2009/0294110 | A1* | 12/2009 | Foust | 165/152 |

OTHER PUBLICATIONS

English language Abstract for JP-60-65775U; published Sep. 16, 1994.

Japanese Office Action dated Aug. 25, 2014 (7 pages).

Japanese Office Action dated Jun. 9, 2015 (5 pages).

* cited by examiner

HEAT EXCHANGER

The invention relates to a method for producing a plate heat exchanger from a multiplicity of rectangular separating sheets which are arranged, spaced apart from one another, in stack form, so that passages are formed between the separating sheets, the passages being delimited by spacers (sidebars) on at least two sides, a solder being applied at the contact points between separating sheets and sidebars, the separating sheets, arranged in stack form, and the sidebars being soldered together into a block, and means for the supply and discharge (headers) of fluids being attached to the block. The invention is described in terms of a plate heat exchanger made from aluminium, but can basically be used for the production of any desired heat exchanger which has the features according to the precharacterizing clause of claim 1. In particular, the present invention is suitable for the production of plate heat exchangers made from high-grade steel or high-temperature steel, which are based on what is known as the bar/plate principle. The invention also relates to plate heat exchangers produced by the above described method.

Conventionally, plate heat exchangers made from aluminium for heat exchange between at least two media consist of a multiplicity of passages which are arranged in stack form and are separated from one another by means of separating sheets. The individual passages are arranged basically in a similar way and in parallel. Heat exchange between the media participating in the heat exchange in this case takes place between adjacent passages, the passages and therefore the media or pressure spaces being separated from one another by means of sheets, usually designated as separating sheets. Heat exchange takes place by means of heat transmission via the separating sheets.

According to the prior art, inside the individual passages there is a wavy structure which forms the ducts for routing the medium. The wave crests of the wavy structure are connected in each case to the adjacent separating sheets. The media participating in the heat exchange are therefore in direct thermal contact with the wavy structures, so that the heat transition is ensured by the thermal contact between the wave crests and the separating sheets. To optimize the transmission of heat, the orientation of the wavy structure is selected as a function of the application such that co/cross/counter- or cross/counter-flow between adjacent passages becomes possible. A heat exchanger of this type is also described in DE 103 43 107.

The wavy structures inside the passages fulfil three objects. On the one hand, the thermal contact between the wavy structure and the separating sheet ensures heat exchange between two media in adjacent passages. On the other hand, the wavy structures make the connection with the separating sheet. Thirdly, the flanks of the wavy structure serve for introducing the forces arising due to the internal pressure into the connection between the wave crest, solder and separating sheet.

According to the prior art, the wavy structures are formed by sheets having an at least partially wavy profile. The mostly thin sheets are folded into wavy structures by means of a press or other tools suitable for forming. Another wavy structure according to the prior art is described in the applicant's patent application pending under file number DE 10 2009 018 247 at the German Patent and Trade Mark Office. Here, the wavy structures are formed by profiles, such as, for example, hollow profiles of rectangular cross section.

Plate heat exchangers of this type are produced, according to the prior art, as follows. The essentially rectangular separating sheets are arranged, spaced apart from one another, in stack form, so that passages, through which the fluids participating in the heat exchange can flow, are formed between the separating sheets. For spacing, spacers, known as sidebars, are introduced between the separating sheets on at least two sides. In the production of a plate heat exchanger having wavy structured passages, the sheets having an at least partially wavy profile and the separating sheets are always stacked alternately or a separating sheet is laid in each case onto a layer of profiles arranged next to one another. The height of the profiles or the structure depth of the sheets having an at least partially wavy profile corresponds in this case to the height of the spacers. Separating sheets, sidebars and sheets having an at least partially wavy profile and profiles are provided with a solder at their respective contact points. The stack thereby occurring is soldered as a whole into an essentially parallelepipedal block in a soldering furnace. The block is in this case mostly delimited outwardly by cover sheets, that is to say sheets with a greater thickness than the separating sheets. In a final step, the block thus obtained is provided with means for the supply and discharge of the media participating in the heat exchange. These headers, as they are known, are mostly semi-cylindrical and are welded onto the heat exchanger block at the corresponding points. They serve for collecting and distributing the media participating in the heat exchange.

A plate heat exchanger of this type according to the prior art often consists of individual modules. In the context of this application, a module is understood to mean an essentially parallelepipedal block which has been produced in the way described above. In plate heat exchangers of this type, the headers frequently extend over a plurality of modules.

When the headers are being welded on, according to the prior art a buffer layer, as it is known, is mostly applied first. This buffer layer is a weld seam which is welded onto the blocks as a welding base for the headers, at the same time compensates the different tolerances of the individual blocks and serves for absorbing the thermal stresses arising during welding.

In some applications of plate heat exchangers of this type, the need arises to remove the headers at more or less regular time intervals. This is necessary, for example, when plate heat exchangers of this type are used as reactors. In these applications, the passages are often filled with catalyst material. This catalyst material has to be removed from the passages at regular time intervals for regeneration. This makes it necessary to remove the headers at regular intervals. According to the prior art, the headers are removed by means of mechanical separation methods, for example cut-off grinding or milling, and, after the spent catalyst material has been extracted from the plate heat exchanger and the latter has been refilled with fresh catalyst material, are welded on again.

It has been shown that, in plate heat exchangers of this type, basically problems occur, when headers are being welded on, at the transitions between the sidebars and separating sheet due to the solder material lying between them, and, moreover, with an increase in operating time, leak-tightness problems arise.

The object on which the present invention is based, therefore, is to configure a method for producing a plate heat exchanger of the type mentioned in the introduction, in such a way that the leak-tightness and mechanical stability of the plate heat exchanger thus produced are maintained even in applications which necessitate a frequent removal and reattachment of the headers.

The present object is achieved by means of a method for producing a plate heat exchanger according to claim 1. Advantageous refinements of the production method are given in the subclaims.

According to the invention, the headers are not welded directly onto the heat exchanger block, but, instead, are welded onto an intermediate piece which has previously been soldered onto the block. In a production method according to the prior art, the headers are welded onto the heat exchanger block directly or via a buffer layer. However, it was shown, surprisingly, that this direct welding onto the soldered points of the heat exchanger block causes the problems regarding the leak-tightness and mechanical stability of the plate heat exchanger. Due to the high introduction of heat, necessary for welding, the solder in the immediate vicinity of the welding operation becomes partially liquid again, with the result that the soldered points are damaged by the welding. This causes problems with regard to the leak-tightness and mechanical stability of the heat exchanger. The problems arise particularly in plate heat exchangers, the use of which necessitates a frequent removal and rewelding of the headers. These problems are avoided by means of the intermediate piece according to the invention. The use according to the invention of an intermediate piece prevents the solder of the block becoming liquid during welding. The mechanical stresses arising due to the introduction of heat in the welding operation or during the mechanical removal of the headers are not transferred to the heat exchanger block. Thus, the leak-tightness and mechanical stability of the plate heat exchanger are maintained even after the headers have been removed and installed several times. The intermediate piece may in this case either be applied directly to the stack before the first soldering operation, so that the heat exchanger block directly contains, after soldering, the intermediate pieces for attaching the header. Alternatively, the attachment of the intermediate pieces is also possible in a second soldering operation. This applies particularly when the resulting plate heat exchanger consists of a plurality of modules.

In a block consisting of a plurality of modules, the individual modules are machined mechanically to a common final dimension. Subsequently, the intermediate pieces are soldered to each individual module, the intermediate pieces also serving here as an additional element for connecting the modules by means of welding.

Preferably, sheets or profiles having an at least partially wavy profile are introduced into the passages before the soldering operation and are provided with a solder at the contact points with the separating sheets. As a result of this refinement of the invention, plate heat exchangers having wavy structured passages can be produced. In this case, separating sheets and sheets or layers of individual profiles having an at least partially wavy profile are in each case stacked one on the other alternately and provided with solder at the contact points. The block obtained is advantageously closed off on at least one side by means of a cover sheet, the cover sheet having a greater thickness than the separating sheets. Alternatively, two separating sheets may also be used one above the other as a cover sheet.

Advantageously, the intermediate piece is produced in the form of the header. Preferably, the intermediate piece used is a frame. The headers are mostly in the form of a semi-cylinder. In this refinement of the invention, therefore, frames corresponding in the form of a rectangle to the basic contour of the semi-cylinders are used as intermediate pieces. The frames are in this case advantageously produced either by being cut out from a planar sheet plate or by flat material being welded together to form a frame, with subsequent mechanical machining. In this case, as a result of the suitable dimensioning of the frame, the thermal and mechanical influence arising due to the operation of welding the header or to the mechanical removal of the header can be minimized. The size of the frame is in this case adapted to the size of the block and of the header. The width of the frame in this case advantageously corresponds to the width of the sidebars. Preferably, frames with a thickness of between 6 mm and 10 mm are used.

In a preferred refinement, the form of the intermediate piece is milled out from the block, the intermediate piece provided with solder is fitted into the milled-out part of the block, is preferably tacked on by means of spot welding, and is subsequently soldered to the block. In this refinement of the invention, advantageously, the contour of the intermediate piece is milled out. If, for example, frames are used as an intermediate piece, the form of the frame is milled out on the block. The frame is fitted into the milled-out part of the block and is preferably fastened by tacking by means of spot welding. For soldering the frame, the same solder is preferably used which was used for soldering the entire block. Instead of milling out the contour of the intermediate piece, other mechanical cutting methods may also be employed.

Advantageously, the intermediate piece is arranged on what are known as dummy passages, through which fluids do not flow during the later use of the plate heat exchanger. It is likewise expedient to use only one solder for producing the plate heat exchanger.

Especially preferably, the separating sheets, the cover sheets, the at least partially profiled sheets, the profiles, the intermediate piece and/or the headers are produced from high-grade steel or a high-temperature steel, preferably molybdenum steel or chrome/nickel steel. The method according to the invention is suitable especially for the production of plate heat exchangers made from high-grade steel or high-temperature steel. Plate heat exchangers of this type are employed in various process segments in air separation plants, petrochemical plants, hydrogen plants or natural gas plants. In natural gas plants, natural gas heat is extracted via plate heat exchangers of this type, and the natural gas is thereby liquefied and separated from the secondary products. In synthesis gas plants, too, a plate heat exchanger of this type may be employed, inter alia, for the separation and further utilization of substances ($H_2$, CO, $CO_2$, $CH_4$) or for preheating the batch materials. In ethylene plants, plate heat exchangers of this type are employed for the separation of ethylene, and in air separation plants plate heat exchangers are used as condensers and evaporators.

In one refinement of the invention, the intermediate piece and/or header are/is produced from a material other than that of the remaining parts of the plate heat exchanger. It was shown that the welding operation can be carried out more simply in the case of a chrome/nickel steel than in the case of high-grade steel. It is therefore also advantageous in a plate heat exchanger made from high-grade steel to produce the intermediate piece and/or the header from chrome/nickel steel.

Advantageously, the thickness of the separating sheets varies within the block in a plate heat exchanger made from high-grade steel or a high-temperature steel, preferably molybdenum steel or chrome/nickel steel. In a plate heat exchanger of this type, the degree of subsidence on account of solder layer thicknesses is low, and therefore material consumption can be optimized by varying the separating sheet thickness.

The present invention makes it possible, in particular, to configure a method for producing a plate heat exchanger in such a way that the plate heat exchanger thus produced has a high leak-tightness and mechanical stability. This applies particularly even to plate heat exchangers, the use of which requires a frequent removal and renewed welding of the headers.

Figure 2:
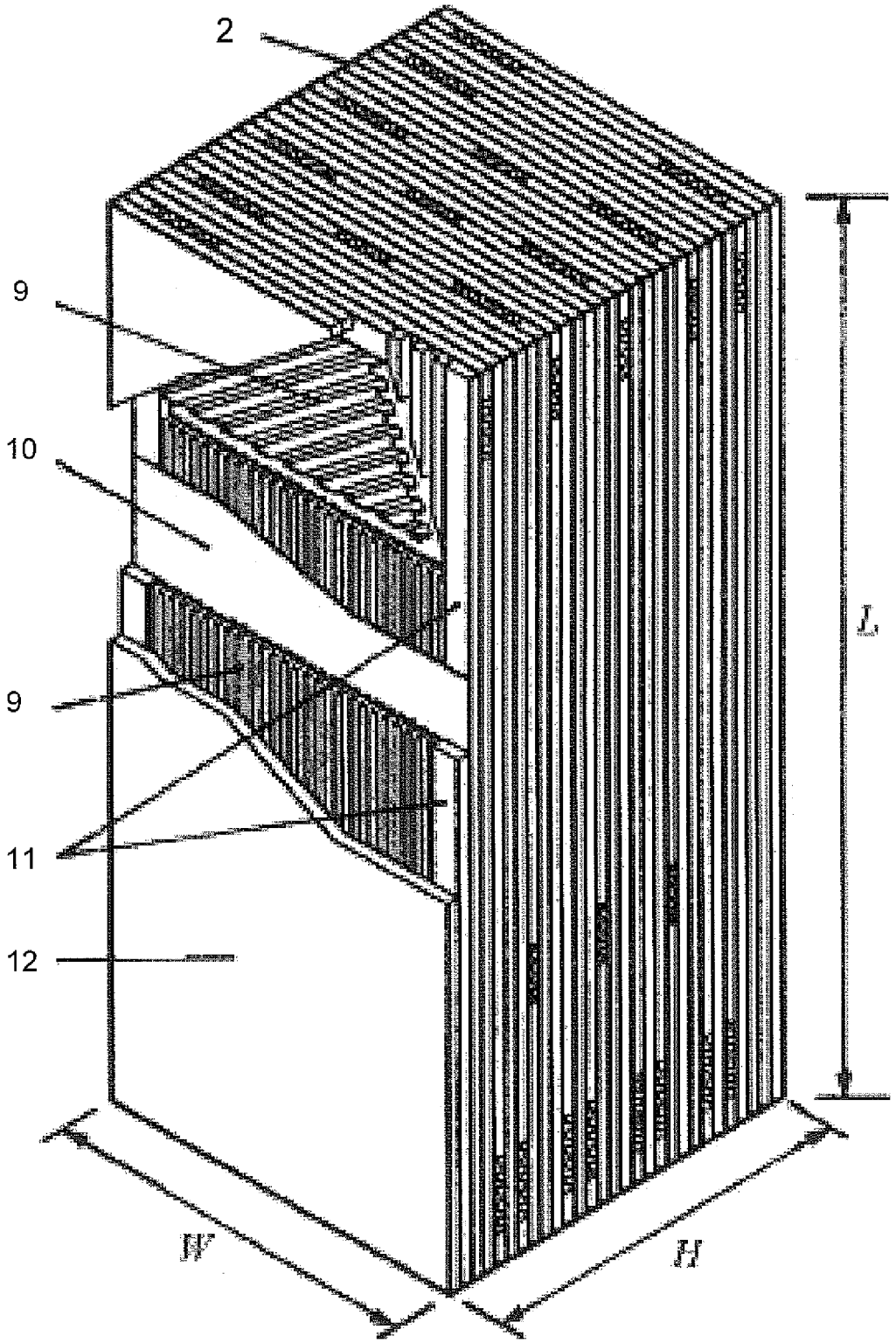

The invention will be explained in more detail below by means of an exemplary embodiment illustrated in the figures in which:

FIG. 1 shows a plate heat exchanger produced according to an embodiment of the method according to the invention, and FIG. 2 shows the block of the plate heat exchanger from FIG. 1 in detail.

FIG. 1 shows a plate heat exchanger 1, such as is produced according to one embodiment of the method according to the invention. According to this embodiment of the invention, sheets 9 having an at least partially wavy profile and separating sheets 10, together with sidebars 11, are stacked one above the other, provided with solder and soldered together in such a way that a block 2 is obtained. The block is closed off outwardly by means of the cover sheets 12. The contours of the intermediate pieces 3 are milled out at the respective positions 4 on the block 2 thus obtained. In this embodiment of the invention, the intermediate pieces 3 used are frames. The frames 3 are positioned in the milled-out portions at the positions 4, provided with solder and tacked on by means of spot welding. Subsequently, in a second step, the frames 3 are soldered onto the heat exchanger block 2. In each case the headers 5*a* and 5*b* are welded onto the frames 3. The heat exchanger 1 thus produced serves for heat exchange between two different fluids which are supplied and discharged in each case via the headers 5*a* and 5*b*. The headers 5*a*, 5*b* also have connection pieces 8 where the plate heat exchanger 1 is connected to the plant. In addition, fastenings 6 and battens 7 are also attached to the heat exchanger 1 in order to connect the heat exchanger 1 to its surroundings in the plant.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The entire disclosures of all applications, patents and publications, cited herein and of corresponding DE application No. 102009048103.6, filed Oct. 2, 2009, are incorporated by reference herein.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A method for producing a plate heat exchanger (1) from a multiplicity of rectangular separating sheets (10) which are arranged, spaced apart from one another, in stack form, so that passages are formed between the separating sheets, the passages being delimited by sidebars (11) on at least two sides, said method comprising:

applying a solder at contact points between said separating sheets (10) and said sidebars (11), soldering said separating sheets (10), arranged in stack form, and said sidebars (11) together into a block (2), and attaching headers (5*a*, 5*b*) for supply and discharge of fluids to said block (2), each of said headers having a connection piece (8) to connect the heat exchanger to a plant, wherein said headers (5*a*, 5*b*) are each welded onto an intermediate piece (3) which has previously been soldered onto the block (2) wherein the intermediate piece (3) is a flat frame having a shape and size corresponding to a surface of one of said headers (5*a*, 5*b*) that is to be attached to said block (2) and wherein the intermediate piece has a thickness of 6 mm-10 mm.

2. The method according to claim 1, further comprising introducing at least partially profiled sheets (9) or profiles into the passages before said soldering of said separating sheets and said sidebars together into a block, wherein said least partially profiled sheets (9) or profiles are provided with a solder at contact points with said separating sheets.

3. The method according to claim 1, wherein the block (2) is closed off on at least one side by means of a cover sheet (12), the cover sheet (12) having a greater thickness than the separating sheets.

4. The method according to claim 1, wherein a form of the intermediate piece (3) is milled out on the block (2), the intermediate piece (3) provided with solder is fitted into the milled-out part of the block (2), and is subsequently soldered to the block (2).

5. The method according to claim 1, wherein said the intermediate piece (3) is arranged over a portion of said passages, through which fluids do not flow during use of the plate heat exchanger (1).

6. The method according to claim 1, wherein only one kind of soldering material is used for all of said solderings for producing the plate heat exchanger (1).

7. The method according to claim 2, wherein the separating sheets (10), the cover sheets (12), the at least partially profiled sheets (9), the profiles, the intermediate piece (3) and/or the headers (5*a*, 5*b*) are made from high-grade steel or a high-temperature steel.

8. The method according to claim 1, wherein said intermediate piece (3) and/or said headers (5*a*, 5*b*) are/is produced from a material that differs from the remainder of the plate heat exchanger (1).

9. The method according to claim 1, wherein thickness of the separating sheets (11) varies within the block (2).

10. A plate heat exchanger (1) comprising a multiplicity of rectangular separating sheets (10) which are arranged, spaced apart from one another, in stack form, with passages formed between the separating sheets, the passages being delimited by sidebars (11) on at least two sides, a solder being applied at contact points between said separating sheets (10) and said sidebars (11), said separating sheets (10) arranged in stack form, and said sidebars (11) being soldered together into a block (2), and headers (5*a*, 5*b*) for the supply and discharge of fluids being attached to the block (2), each of said headers having a connection piece (8) to connect the heat exchanger to a plant, and wherein each of said headers (5*a*,5*b*) is welded onto an intermediate piece (3) which has previously been soldered onto said block (2) wherein the intermediate piece (3) is a flat frame having a shape and size corresponding to a surface of one of said headers (5*a*, 5*b*).

11. The plate heat exchanger of claim 10 wherein at least partially profiled sheets (9) or profiles are introduced into the passages before the soldering of said separating sheets and said sidebars together into a block and are provided with solder at contact points with said separating sheets.

12. The plate heat exchanger of claim 10 wherein the block (2) is closed off on at least one side by means of a cover sheet (12), the cover sheet (12) having a greater thickness than the separating sheets (11).

13. The plate heat exchanger of claim 10, wherein in each case said intermediate piece (3) is a frame having a shape corresponding to the surface of the header (5*a*, 5*b*) that is to be attached to said block (2).

14. The plate heat exchanger of claim 10 wherein the intermediate piece (3) is milled out on the block (2), the intermediate piece (3) being provided with solder is fitted into the milled-out part of the block (2), and is tacked on by spot welding and is subsequently soldered to the block (2).

15. The plate heat exchanger of claim 10 wherein the intermediate piece (3) is arranged over a portion of said passages, through which passages fluids do not flow during use of the plate heat exchanger (1).

16. The plate heat exchanger of claim 10 wherein only one solder is used for producing the plate heat exchanger (1).

17. The plate heat exchanger of claim 11, wherein the separating sheets (10), the cover sheets (12), the at least partially profiled sheets (9), the profiles, the intermediate piece (3) and/or the headers (5*a*, 5*b*) are made from high-grade steel or a high-temperature steel.

18. The plate heat ex changer of claim 10 wherein the intermediate piece (3) or the headers (5*a*, 5*b*) are produced from a material that differs from the remainder of the plate heat exchanger (1).

19. The plate heat exchanger of claim 10 wherein thickness of the separating sheets (11) varies within the block (2).

20. The method according to claim 7, wherein the separating sheets (10), the cover sheets (12), the at least partially profiled sheets (9), the profiles, the intermediate piece (3) and/or the headers (5*a*, 5*b*) are made from molybdenum steel or chrome/nickel steel.

21. The method according to claim 1, wherein a form of the intermediate piece (3) is milled out on the block (2), the intermediate piece (3) provided with solder is fitted into the milled-out part of the block (2), tacked on by means of spot welding, and subsequently soldered to the block (2).

22. The plate heat exchanger of claim 17, wherein the separating sheets (10), the cover sheets (12), the at least partially profiled sheets (9), the profiles, the intermediate piece (3) and/or the headers (5*a*, 5*b*) are made from molybdenum steel or chrome/nickel steel.

* * * * *